US006606462B2

(12) United States Patent
Siegel et al.

(10) Patent No.: US 6,606,462 B2
(45) Date of Patent: Aug. 12, 2003

(54) RELIABILITY MODEL BASED COPY COUNT CORRECTION WITH SELF MODIFICATION DURING SYSTEM RECOVERY FOR PREDICTIVE DIAGNOSTICS

(75) Inventors: Robert P. Siegel, Penfield, NY (US); Tracy E. Thieret, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/042,340

(22) Filed: Jan. 11, 2002

(65) Prior Publication Data

US 2003/0133720 A1 Jul. 17, 2003

(51) Int. Cl.[7] ..... G03G 15/00
(52) U.S. Cl. ..... 399/24; 399/19; 399/43
(58) Field of Search ..... 399/19, 24, 27, 399/30, 23, 43

(56) References Cited

U.S. PATENT DOCUMENTS 4,496,237 A 1/1985 Schron
4,860,052 A * 8/1989 Ito et al. ..... 399/24
5,717,974 A * 2/1998 Park ..... 399/24
6,215,966 B1 * 4/2001 Yang et al. ..... 399/27
6,473,572 B1 * 10/2002 Uchiyama et al. ..... 399/24

FOREIGN PATENT DOCUMENTS

JP 9-90753 * 4/1997

* cited by examiner

*Primary Examiner*—Susan S. Y. Lee
(74) *Attorney, Agent, or Firm*—Christopher D. Wait

(57) ABSTRACT

The present invention relates to providing supplemental counts or "clicks" to account for recovery conditions in a document processing system. Furthermore, these recovery condition "clicks" will be further modified depending upon the type of recovery condition encountered. The application of recovery counts thus modified when combined with the system cycle count and suitably summed will provide superior measure of the wear for a replaceable element as well as improved indication for the determination of the end of life of a replaceable element in that system. In this manner, the more timely service or substitution for that replaceable element in the system can be provided, thereby allowing costs and service down-time to be minimized.

26 Claims, 3 Drawing Sheets

RELIABILITY MODEL BASED COPY COUNT CORRECTION WITH SELF MODIFICATION DURING SYSTEM RECOVERY FOR PREDICTIVE DIAGNOSTICS

Cross reference is made to patent application U.S. Ser. No. 10/029,346, and U.S. Ser. No. 10/029,330, with the same inventors as present here, which is herein incorporated in its entirety for its teachings, and for which there is common assignment with the present application to the Xerox Corporation.

BACKGROUND OF THE INVENTION AND MATERIAL DISCLOSURE STATEMENT

The present invention relates generally to the reliability of a replaceable element in a complex system. The invention relates more importantly to the life remaining for a replaceable element so that timely replacement may be made without unduly increasing operation costs resulting from too early a replacement or, in the alternative, a parts failure from waiting too long to replace. The invention relates in particular with regards high frequency service items (HFSI) and customer replaceable units (CRU). The invention relates more particularly to using counters to determine replacement of HFSI and CRU in document processing systems.

Current day machine architecture allows for the use of HFSI counters, which keep track of the number of copies/prints that utilize certain key components in a document processing system and, thus, contribute to their wear. There are a number of these counters typically each associated with a particular replaceable element so that they can be reset independently when, for example, a photoreceptor is replaced. Many replaceable parts have such a counter associated with them. They are useful in a service strategy where the individual part is scheduled for replacement when the counter associated with that part reaches a predetermined value (the "life" of the part). The idea is to replace parts just before they fail so as to avoid unnecessary machine down time and loss of productivity. When the part is replaced, the associated HFSI counter is reset to zero. These predetermined values are obtained by examination of a population of the parts in question, determining the mean time between failure, and a judgment on the expected life of the part is made. This judgment targets the replacement of the part just before the average life of the part as measured in "clicks" has transpired. By "clicks" what is meant is the number of iterations of system cycles—usually the number of prints/copies made in a document processing system, for example. The problem here is that this judgment needs to provide a conservative estimate of life so that the part does not fail before the scheduled replacement date which means that a certain measure of useful life is being wasted.

The counters are also implemented in a way that the specific counts are only incremented when the pertinent features are being utilized. So, in a copier or printer, for example, any counters associated with Tray 2 are not incremented when only Tray 1 is being used. Each part so designated has its own counter.

In U.S. Pat. No. 4,496,237 to Schron, the invention described discloses a reproduction machine having a non-volatile memory for storing indications of machine consumable usage such as photoreceptor, exposure lamp and developer, and an alphanumeric display for displaying indications of such usage. In operation, a menu of categories of machine components is first scrolled on the alphanumeric display. Scrolling is provided by repetitive actuation of a scrolling switch. Having selected a desired category of components to be monitored by appropriate keyboard entry, the sub-components of the selected category can be scrolled on the display. In this manner, the status of various consumables can be monitored and appropriate instructions displayed for replacement. In another feature, the same information on the alphanumeric display can be remotely transmitted. The above is herein incorporated by reference in its entirety for its teaching.

The difficulty with the current scenario is that "clicks" alone are not an accurate measure of the wear experienced by system components. The use of a simple, non-specific, incremental value to track the wear on all components does not acknowledge the specific stresses that each individual component faces and, thus, is inaccurate in assessing the remaining life available for the part. One "click" will correspond to different wear increments for different parts. There are many situations where a part is exercised much more than the click count would indicate and some where it is exercised less. In particular, during system recovery from a fault or shutdown condition, there is an often an overhead to clearing, cleaning and resetting the system. For example, in document processing systems when a paper jam occurs considerable extra wear may be incurred in recovering from the jam in the clearing of the paper path and the cleaning of the image path. Furthermore, the type and severity of system fault or shutdown being recovered from needs to be compensated for in the recovery click counts. When the HFSI counter is grossly inaccurate on the low side, parts are considered OK when in fact their useful life has expired. The part fails and the device becomes inoperable and unproductive until the customer service engineer arrives, identifies the failure, and repairs the machine. If the estimate is too high, the part is replaced even though it has a measure of useful life remaining. Either case leads to inefficiencies in the parts replacement strategy and incurs increased costs thereby.

Therefore, as discussed above, there exists a need for an arrangement and methodology, which will solve the problem of preventing unnecessary machine system down time or parts expenditure resulting from too early or too late a replacement. Thus, it would be desirable to solve this and other deficiencies and disadvantages, as discussed above, with an improved methodology for more accurately accounting and monitoring wear characteristics in complex systems.

The present invention relates to a method for assessing an end of life determination for a replaceable element in a system comprising accepting a system cycle as a nominal count while monitoring the system for a recovery condition, as well as for the type of recovery and providing a recovery count modified by the type of recovery in the event of the recovery condition. This is followed by summing the nominal count and the recovery count into a supplemental diagnostic counter.

In particular, the present invention relates to a method for assessing end of life determinations for high frequency service items in a document processing system comprising accepting a document processing system cycle as a nominal count and applying at least one weighting factor to the nominal count to yield at least one weighted count while monitoring the system for a recovery condition as well as for the type of recovery. This is followed by providing a recovery count modified by the type of recovery in the event of the recovery condition and summing the one or more weighted counts and the recovery count into a supplemental diagnostic counter.

The present invention also relates to a method of assessing end of life determinations for a high frequency service item in a document processing system comprising incrementing a nominal counter by a nominal count for each cycle of the document processing system and applying at least one weighting factor to the nominal count to yield a weighted count. The method further comprises monitoring the system for a recovery condition, as well as for the type of recovery, providing a recovery count modified by the type of recovery in the event of the recovery condition, and monitoring the system for a startup condition also providing a startup count in the event of the startup condition. The method then comprises monitoring the system for a cycle-down condition, providing a cycle-down count in the event of the cycle-down condition and summing the nominal count, the weighted count, the recovery count, the startup count, and the cycle-down count into a supplemental diagnostic counter.

DESCRIPTION OF THE INVENTION

By adding sophistication to the software routines that keep track of the usage of high frequency service items (HFSI) parts in a document processing system, we can improve the predictability of these routines. This will reduce the amount of waste and customer dissatisfaction that comes from replacing parts either too early or too late.

System modeling techniques can be used to represent the relative amount of component stress that a given job contains. One example is to keep track of the number of image pitches that actually take place during cycle-up/cycle-down and count them for all of those subsystems that are impacted. Another example is to use pixel counting to determine the area coverage and use that information to scale the count by the proportional amount of stress that it represents.

Figure 1:
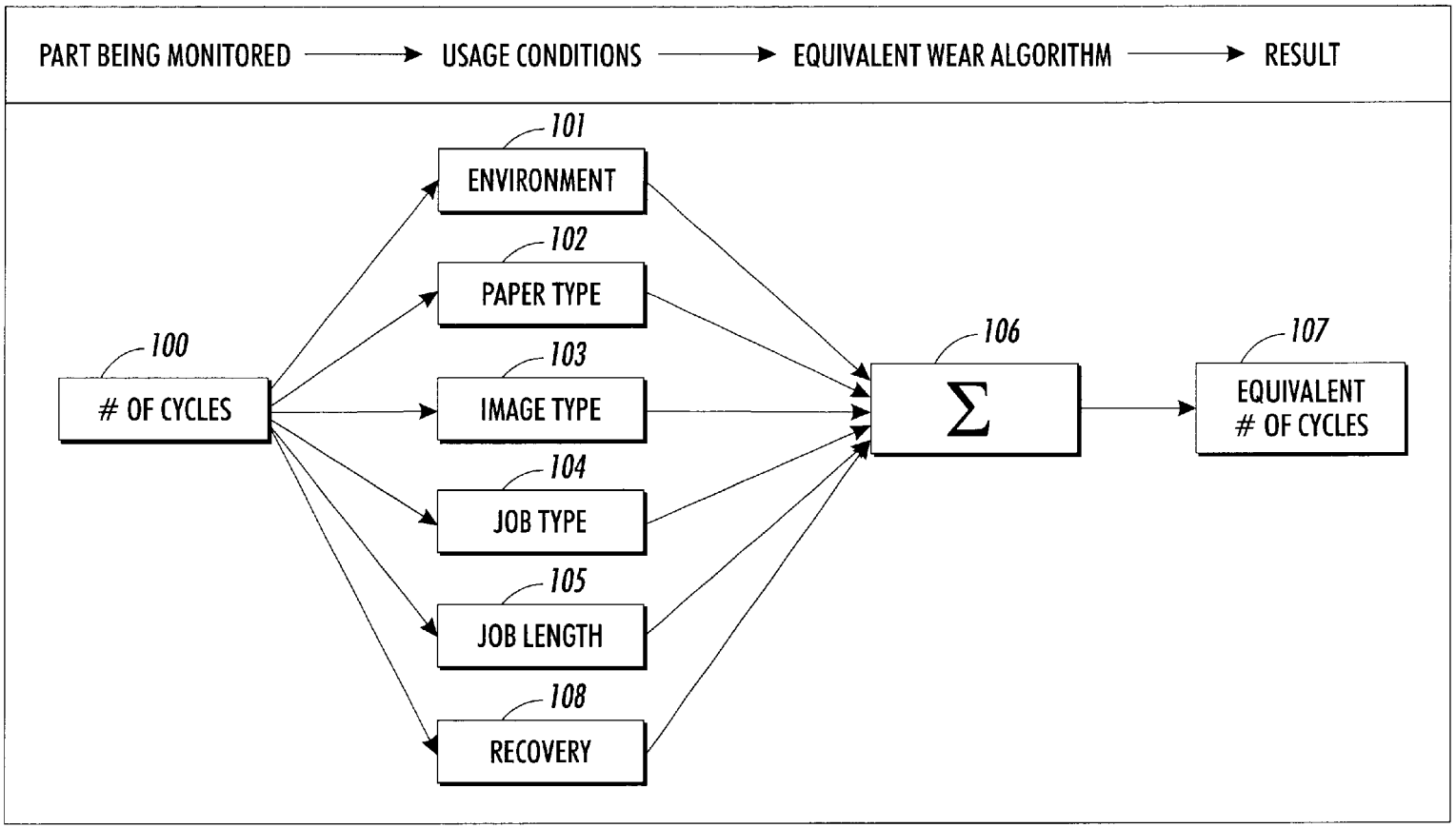
FIG. 1 depicts a flow diagram for the usage conditions and weighting factors for a part being monitored.

The predictability of the current approach can be improved if certain operational characteristics are taken into consideration. The broad teaching here is for the use of estimated or model derived print/copy count adjustments to the HFSI counters that can correlate relative stress levels between certain types of machine usage with the expected life of the various machine subsystems. FIG. 1 depicts a flow chart with the broad concepts pertaining to the teachings of the present invention. Input block 100 is the number of "clicks" or other incremental count or system input data for a part being monitored as is typically already collected in present prior art systems. Of course, in the alternative, for any input data from the part being monitored that is not currently being collected, a new data collector would need to be implemented. In a copier/printer system, for example, the input data being monitored would typically be the number of copies, although there are many other possible parameters such as operation hours.

The input from block 100 is then passed into usage condition weighting blocks 101–105 and 108. These weighting conditions for this embodiment comprise usage block 101 environment, block 102 paper type, block 103 image type, block 104 job type, block 105 job length and block 108 recovery. Weighting considerations for usage block 101 environment would be parameters of temperature and humidity. The weighting considerations for paper type usage block 102 would be concerned with the media type such as transparencies verses paper, as well as paper thickness and weight. Image type considerations as weighed in at block 103 are toner coverage metrics as determined by examining the incoming image data and, in pursuit thereof, may be as simple as pixel counting or involve more complex digital imaging manipulation techniques. In usage block 104, job type considerations such as job requirements for simplex/duplex, covers, and inserts, are the weighting factors. Usage block 105 provides a weighting factor as provided for job run length which allows the difference in stress to the system depending upon whether a single page is copied/printed or many copies/prints are generated for a single job. Finally, in usage block 108 weighting considerations due to the stress of system recovery from system problems are provided for. A couple of illustrative examples as found in printer/copier systems follow below.

In electrostatic-graphic printer/copier document processing systems, for example, it is a well-known fact that short run jobs are more stressful than long run jobs. One reason for this is the percentage of the total job resources consumed by machine cycle-up and cycle-down. In fact, for very short print/copy length jobs, the cycle-up/down may account for more machine stress than the process of making the prints does. That is because cycle-up is used to prepare the system for printing. The belt or drum is charged and given time to reach electrical equilibrium. Measurements are taken of test patches to determine the appropriate charge and bias levels and to calibrate the control system. This must be done each time because the belt continuously changes its electrical properties over time. Some setup procedures have an iterative component so time is required to complete that. At the same time, the fuser and the illumination lamp (where applicable) are warming up. The cleaner is also run to clean the belt of any dust or debris that might have fallen or settled since the last job. For a typical machine, it is not unusual for 10 or more photoreceptor panels to pass by the transfer zone before the first sheet is fed. During this time, many of the key machine subsystems (e.g. P/R, Developer, and Charge) are being exercised in much the same way that they are during the actual print job. Copy/print quality adjustments may consume many machine resources without contributing to the "click" count input to block 100 at all. Cycle-down is generally shorter. It is primarily used to run the cleaner after the job is complete and move waste toner into the sump. Some diagnostic test routines may also be run during this time. Any paper that is still in the system must be purged out as well to bring the machine back to a ready-to-run condition.

It is important then to count those extra photoreceptor panels as usage for those subsystems rather than relying solely on the sheets fed and printed. So, if a given printer/copier machine runs ten blank photoreceptor panels before making the first print, and a customer runs 3 images, the enhanced HFSI counters for those impacted sub-systems would provide for a count of 13 rather than three. The output of usage block 105 will provide a weighted count to account for just such a scenario. Over a long period in which many short run jobs are made, the counts could be quite different than what a simple print counter will show. In the case of a 1000 sheet run, the 10 cycle up copies would be negligible reflecting the is fact that the relative impact of cycle up in a long run is negligible.

Another usage mode provided for by usage block 103 in the FIG. 1 model is % area coverage. Since the amount of toner on an image can affect the stress on the developer, P/R, cleaner, and fuser, a proportionality factor is used. For example, if a basic text document with 10% area coverage were considered nominal, a pictorial image with 35% coverage would tend to stress those subsystems more. It is unlikely however that this document is really 3.5 times as stressful in terms of reliability and wear. Detailed modeling, or empirical data, would provide an influence factor for area coverage. The influence factor would moderate the effect of area coverage by a given percentage. For example, it may be determined that the influence of area coverage is 20% at most. That would mean that from a wear perspective a dark dusting (100% coverage) would generate the equivalent of 2 copy counts per page as shown below:

$$100\%/10\% \times 20\% = 2.0$$

In other words, Actual Coverage divided by the Nominal Coverage and multiplied times the Influence Factor would generate the weighting factor that is then the output of usage block 103. It will be apparent to one skilled in the art that embodiment with additional sophistication can be added to this. For example, in another embodiment, not only area coverage but also density can be included. In a yet a further alternative embodiment, a direct pixel count of the input data image can be used.

Other stress factors addressed by usage block 102 are paper size and paper weight. There are a number of stresses well known in the printer/copier arts. For example, there is the 11" wear mark on fuser rolls. A favorable mix of 14" sheets could actually reduce the stress on the fuser and, thus, independently keeping track of 11" sheets would be beneficial. Heavy weight papers can stress drive elements, requiring more torque. Transparencies can stress fuser rolls because of higher adhesion forces and the higher fusing temperatures required to improve color transparency performance. De-lamination of fuser rolls is a function of the integral of temperature and time and the magnitude of the thermal gradients that the fuser must endure. All these can contribute to the life expectancy calculation of this high cost replacement item as determined in usage block 102.

The usage block 108 for recovery, provides for the stress various replaceable elements incur in system breakdown situations like power failure or power interruption, and as is often experienced in document processing systems, paper jam. The wear patterns so incurred can vary significantly depending upon where the jam occurs and on when in the job cycle the jam occurs. The stress during recovery may further vary depending on the kind of print job being executed as well.

Returning to FIG. 1, the weighted counts as determined by the weighting factors in the usage blocks 101–105 and 108 are combined at summation block 106. In one preferred embodiment as shown at block 107, the resultant summation from summation block 106 is expressed as an equivalent number of system cycles or "clicks" although they need not be an integer quantity. It may also comprise a fractional part of a "click". The idea is that the customer or field engineer for whom this is provided is most comfortable in determining the need to replace a serviceable unit working within the paradigm of copy counts or "clicks". This representation is also more compatible with information systems that deal with replacement intervals in these same terms. However, it will be apparent to those skilled in the art other representations maybe used.

Figure 2:
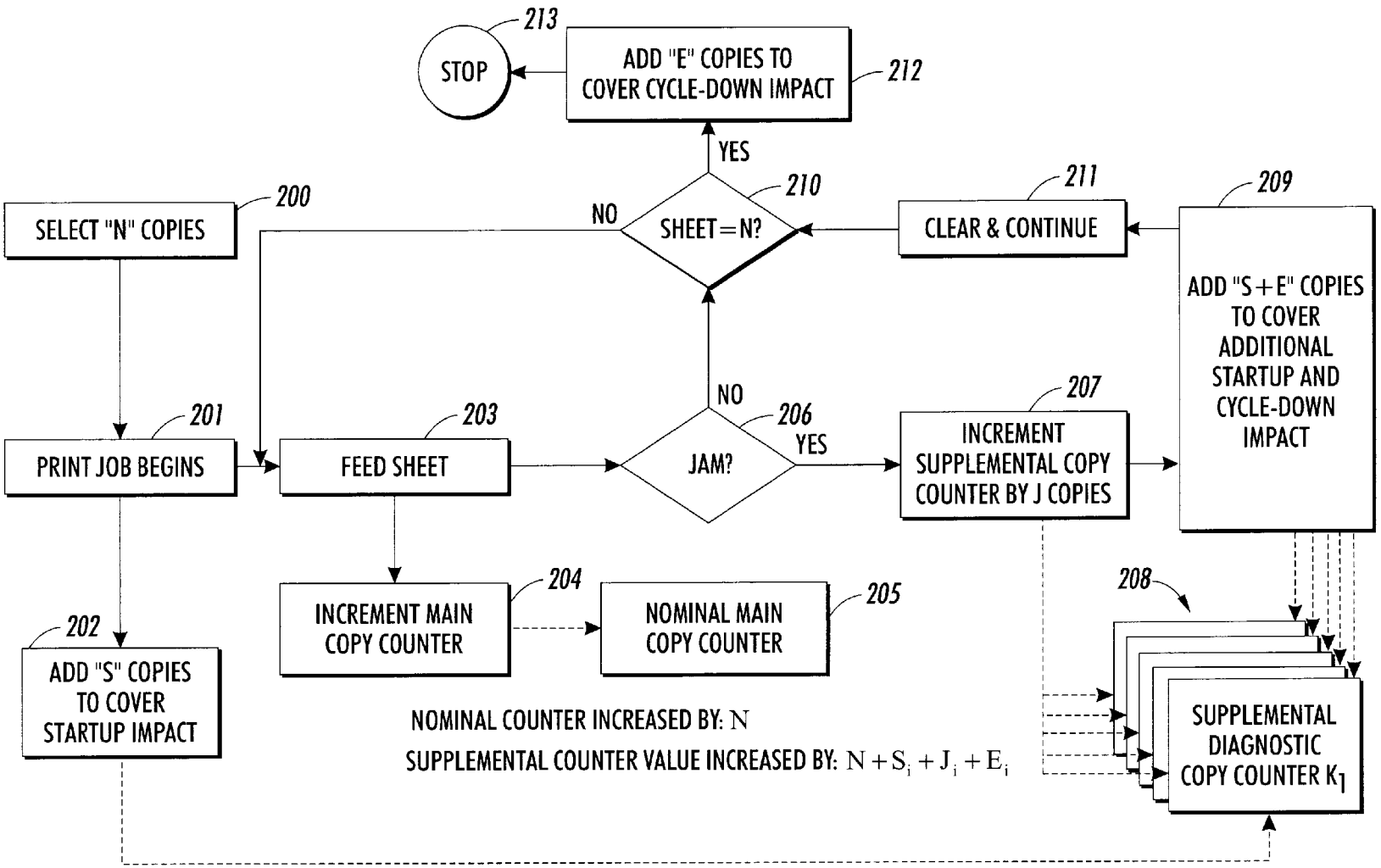
FIG. 2 depicts a flow diagram for the process flow for smart copy count correction showing startup, cycle down and paper path jam impact factors.

FIG. 2 depicts the process flow for smart copy count correction from system recovery showing the accommodation of startup cycle down and paper path jam impact factors in a copier embodiment. Starting with block 200, user input determines a selection of some initial number of copies "N". Then as depicted at block 201, the print job begins. An increment of "S" copy clicks, as shown at block 202, is included to cover the startup impact. The number "S" may be ten as discussed above, however, this is machine dependent and will, therefore, vary from system to system. Concurrent with the startup impact increment of block 202, the print job will request the appropriate number of sheet feeds 203. Each sheet feed will increment the nominal main copy counter 205 as is shown at step 204. The sheet feed block 203 will then initiate an assessment of any jam conditions at decision block 206. If there are indeed jam conditions, then at step 207 the supplemental diagnostic copy counters 208 are incremented by "J". This number will vary from system to system and may even vary depending upon the type of jam. For example, a jam during a duplex job will involve clearing the duplex paper path as well as the simplex paper path. The table 1 which follows provides one example embodiment scenario:

TABLE 1

| | Event | | | | |
|---|---|---|---|---|---|
| Machine Area | Startup | Side 1 Jam | Side 2 Jam | High Area Coverage | Cycle-Down |
| Photoreceptor | 10 | 5 | 5 | 0.2 | 7 |
| Cleaner | 12 | 25 | 25 | 0.5 | 9 |
| Fuser | 15 | 5 | 5 | 0.4 | 12 |
| Duplex | 5 | 0 | 10 | 0 | 2 |
| Paper Feeder | 0 | 2 | 0 | 0 | 0 |
| Developer | 12 | 1 | 1 | 0.3 | 10 |
| Registration transport | 3 | 10 | 10 | 0 | 2 |

In the above table, the "Side 1 Jam" event is the simplex paper path situation. Notice that no extra "clicks" are to be incremented for the duplex supplemental diagnostic copy counter 208 in that situation since that portion of the machine is not affected by the event. However, for a "side 2 Jam" event which involves the duplex paper path, there is a tally of 10 clicks for the duplex supplemental diagnostic copy counter 208. So the "J" increment in step 207 is 10 for the duplex supplemental diagnostic copy counter 208 in that situation. In step 209, a summation of startup "S" and cycle-down (or job end) "E" click increments are allotted. Typical incremental "click" values are provided in the table 1 above for the Photoreceptor, Cleaner, Fuser, Duplex Developer, and Registration transport of a document processing system in the jam condition startup and cycle-down situations provided for in step 209. Note that the equivalent values for the cleaner are particularly high, since in the case of a jam, the cleaner must remove the entire untransferred image as opposed to the residual amount of toner left after the image has been transferred to paper as it typically does. The summation performed at step 209 can include weighted counts combined with recovery counts from jam conditions, plus startup and cycle-down counts. When needed, step 211 provides for a clear and continue system reset, providing system sheet purge, and initiating operator diagnostics.

The supplemental diagnostic copy counter 208 is updated in count by the summation of the nominal main count "N", the jam count "J", the startup "S" and the cycle-down "E" counts to yield a much more robust and meaningful indicator of CRU and HFSI wear replacement scheduling in a document processing system. The clear and continue block 211, or if there was no jam the jam decision block 206, toggle decision block 210 where a comparison between the sheet counter and the print job copy number "N" is used to determine if the print job has completed or if the counter should be decremented and a sheet feed command issued to block 203 to repeat the above described sequence until the job is done. Once decision block 210 determines that the job is complete, step 212 provides for the summation of "E" job cycle-down impact clicks into the supplemental diagnostic copy counters 208 and directs the system to a job stop at step 213.

It will be understood by those skilled in the art that a paper jam is just one example of several types of recovery conditions. While a paper jam has been used as an illustrative example however, the same recovery strategies apply to any type of recovery condition for both a fault recovery situation or for a hard shutdown scenario. More specifically, knowledge of the type of fault or shutdown is to be used to further modify the recovery impact counts. A shutdown recovery can occur as the result of a sheet of paper physically stubbing or lodging at a specific location in the paper path. In another scenario it could occur as the result of a sheet delay due to reduced motor speed or slippage between the driving roll and the paper, causing the sheet to arrive outside the allotted time window. A simple fault recovery could occur as the result of a system software error condition or a hard shutdown could ensue from perhaps an electrical power surge that would cause the abnormal termination of the controlling software program and possible reboot. All of these possible recovery scenarios will involve the same typical situation in a document processing system, which is that the machine has come to a stop with one or more sheets in the paper path and one or more images at various stages of construction on the photoreceptor belt or drum. Typically there will be a latent image where the charged portion of the belt has been exposed to the image generating light source, as well as a developed image on the photoreceptor where toner has been applied but not yet transferred to paper. Furthermore, there will be a residual image on the photoreceptor that has not yet entered the cleaner and a sheet of paper with a toner image that has not yet entered the fuser. The recovery procedure will require that all of these sheets be removed from the paper path and the photoreceptor returned to its nominal condition. This process of recovery will create stress levels on the machine that will in many instances be several orders of magnitude higher than what is normally encountered.

Figure 3:
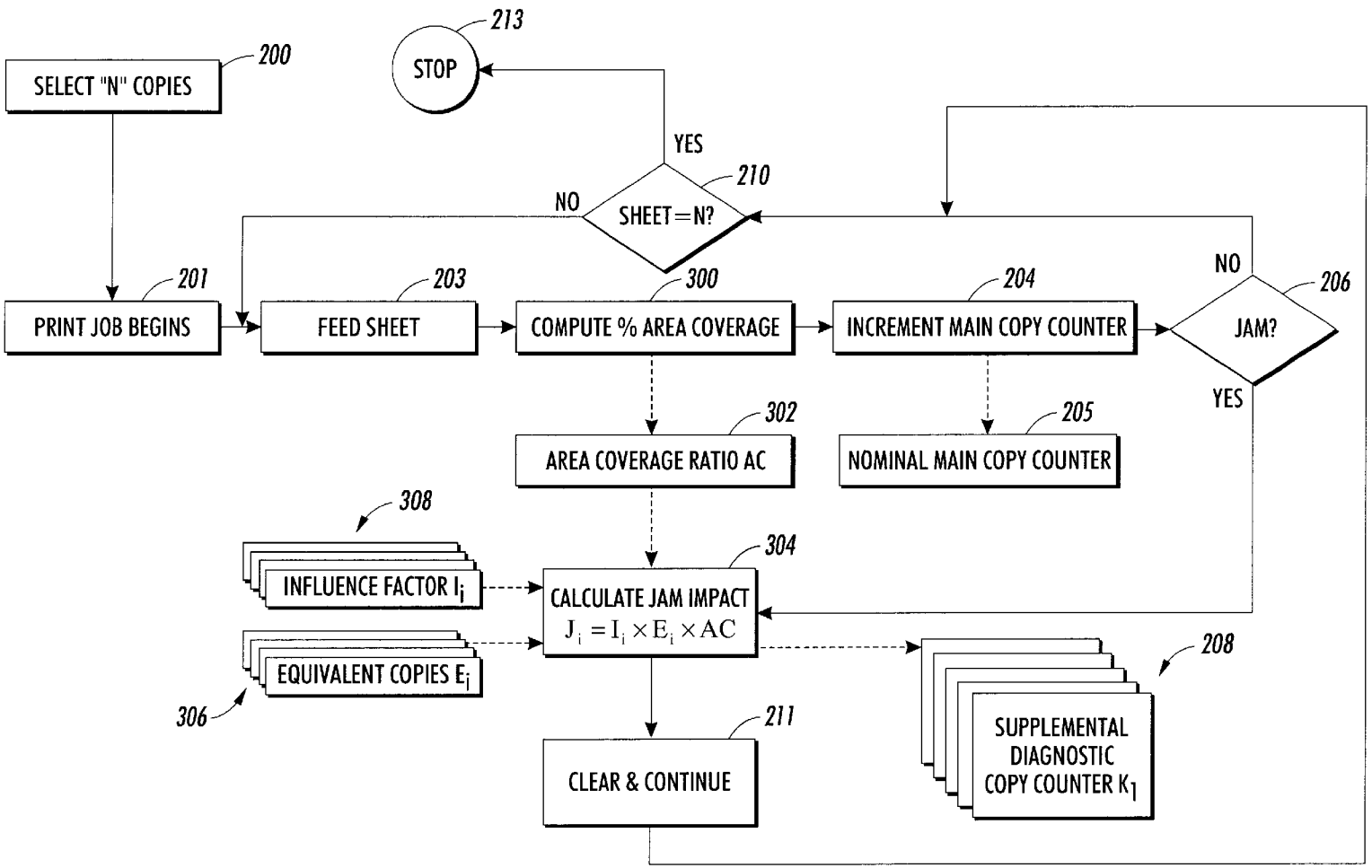
FIG. 3 depicts a flow diagram for smart copy count correction in recovery with self modification dependent upon the recovery scenario.

FIG. 3 provides an alternative recovery mode embodiment. Recovery mode weighting factors and counter increment counts ("clicks") are preferably adjusted depending upon the severity and type of recovery or jam scenario. In a document processing system and, in particular, in an electrostaticgraphic type system, the impact to a transfer drum or transfer belt and their attendant cleaning systems will vary depending upon at what point in the copying cycle the jam interrupt occurs. If, for example, all toner has been transferred from the belt onto paper sheets and then a jam or recovery interrupts, there will be little impact to the belt and its cleaning system. However, if as more likely to happen particularly in a image-on-image color system, the toner happens to be on the belt when a recovery interruption occurs, there will be a very large strain upon the cleaning system in dealing with the abnormal load. This in turn means a considerably higher amount of wear for the both the cleaning system as well as the transfer belt. The difference in load for the cleaner between normal operation and jam clearance may be as much as 1000 times greater. Furthermore, the amount of toner is dependent upon the image which was to be transferred. So, in one embodiment, digital imaging techniques are employed to compare a nominal typical toner coverage and compare it to the actual input image and thereby actual indication of toner upon the belt. This ratio is utilized as an area coverage influence factor and adjusted in impact for each given subsystem. Above, in table 1, the column for high area coverage lists these influence factors for each subsystem as an example embodiment. The influence factor is applied as a multiplier against the equivalent sheet count which is also multiplied by the ratio for a given sheet's actual area coverage relative to nominal sheet coverage. Given a nominal 10% area coverage the resulting impact of a jam of an 80% coverage sheet on the cleaner would be 100 sheets as shown in the following formula:

25 equivalent sheets×80%/10%×0.5 (table 1 cleaner influence factor)=100. So what starts as an initial 25 "clicks" becomes 100 clicks because of higher than nominal area coverage.

Starting at block 200 in FIG. 3, user input determines a selection of some initial number of copies "N". Then as depicted at block 201, the print job begins. An increment of "S" copy clicks may be included to cover the startup impact. The number "S" may be ten as discussed above, however, this is machine dependent and will, therefore, vary from system to system. Concurrent with the startup impact increment, the print job will request the appropriate number of sheet feeds 203. The sheet feed block 203 will then initiate an assessment of percent area coverage at block 300, as discussed above, and provide an area coverage ratio "AC" at block 302. Each sheet feed initiation of block 300 will also increment the nominal main copy counter 205 as is shown at step 204. With the increment main copy counter step 204, a determination of jam conditions is made at decision block 206. If a jam scenario is detected, the next step is to calculate the jam impact at block 304. This pulls the example table 1 data from memory with location/register 306 providing the equivalent copies $E_i$ data and memory location 308 the influence factor $I_i$. As described above, these factors and equivalent copy numbers are multiplied and the result then multiplied against the area coverage ratio AC. Jam impact $J_i=I_i\times E_i\times AC$. This final "click" count result $J_i$ is then used to increment the appropriate supplemental diagnostic copy counter 208 which, in this example, would be the counter for the cleaner. When needed, the next step 211 provides for a clear and continue system reset, providing system sheet purge, and initiating operator diagnostics. The step that follows (or if there was no jam condition determined at decision block 206) is to toggle decision block 210 where a comparison between the sheet counter and the print job copy number "N" is used to determine if the print job has completed or if the counter should be decremented and a sheet feed command issued to block 203 to repeat the above described sequence until the job is done. Once decision block 210 determines that the job is complete, it directs the system to a job stop at step 213.

In closing, employing supplemental counters and inputting both additional startup/rundown considerations, as well as scenario modified recovery counts into those supplemental counters, results in greater accuracy in determining and thereby predicting component end of life wear time. Furthermore, application of this methodology will allow appropriate replacement schedules to be instituted and updated which will thereby minimize both cost and customer down time.

While the embodiments disclosed herein are preferred, it will be appreciated from this teaching that various alternative, modifications, variations or improvements therein may be made by those skilled in the art. For example, it will be understood by those skilled in the art that the teachings provided herein may be applicable to many types of document processing systems including copiers, printers and multifunction scan/print/copy/fax machines with computer, fax, local area network, and internet connection capability. Further, the techniques herein described above may be applied to many different subsystems in the prior listed document processing systems. All such variants are intended to be encompassed by the following claims.

What is claimed is:

1. A method for assessing an end of life determination for a replaceable element in a system comprising:

accepting a system cycle as a nominal count;

monitoring the system for a recovery condition;

monitoring the recovery condition for type of recovery;

providing a recovery count modified by the type of recovery in the event of the recovery condition; and summing the nominal count and the recovery count into a supplemental diagnostic counter.

2. The method of claim 1 wherein the system is a document processing system.

3. The method of claim 2 wherein the recovery condition is recovering from system power loss.

4. The method of claim 2 wherein the recovery condition is recovering from a paper jam.

5. The method of claim 4 wherein the type of recovery is for a high toner area coverage.

6. The method of claim 4 wherein the type of recovery is for low toner area coverage.

7. The method of claim 2 wherein the supplemental diagnostic counter resides in the system.

8. The method of claim 2 wherein the replaceable element item has a customer replaceable unit monitor and the supplemental diagnostic counter resides in the customer replaceable unit monitor.

9. A method for assessing end of life determinations for high frequency service items in a document processing system comprising:

accepting a document processing system cycle as a nominal count;

applying at least one weighting factor to the nominal count to yield at least one weighted count;

monitoring the system for a recovery condition;

monitoring the recovery condition for type of recovery;

providing a recovery count modified by the type of recovery in the event of the recovery condition; and summing the one or more weighted counts and the recovery count into a supplemental diagnostic counter.

10. The method of claim 9 wherein the high frequency service item is a customer replaceable unit.

11. The method of claim 10 wherein customer replaceable unit has a customer replaceable unit monitor.

12. The method of claim 11 wherein the supplemental diagnostic counter resides in the document processing system.

13. The method of claim 11 wherein the supplemental diagnostic counter resides in the customer replaceable unit monitor.

14. The method of claim 13 wherein the at least one weighting factor further comprises a weighting for job type.

15. The method of claim 13 wherein the at least one weighting factor further comprises a weighting for job run length.

16. The method of claim 13 wherein the type of recovery is for a high toner area coverage.

17. The method of claim 13 wherein the type of recovery is for a low toner area coverage.

18. A method for assessing end of life determinations for a high frequency service item in a document processing system comprising:

incrementing a nominal counter by a nominal count for each cycle of the document processing system;

applying at least one weighting factor to the nominal count to yield a weighted count;

monitoring the system for a recovery condition;

monitoring the recovery condition for type of recovery;

providing a recovery count modified by the type of recovery in the event of the recovery condition;

monitoring the system for a startup condition;

providing a startup count in the event of the startup condition;

monitoring the system for a cycle-down condition;

providing a cycle-down count in the event of the cycle-down condition; and, summing the nominal count, the weighted count, the recovery count, the startup count and the cycle-down count into a supplemental diagnostic counter.

19. The method of claim 18 wherein the high frequency service item is a customer replaceable unit.

20. The method of claim 19 wherein customer replaceable unit has a customer replaceable unit monitor.

21. The method of claim 20 wherein the supplemental diagnostic counter resides in the document processing system.

22. The method of claim 20 wherein the supplemental diagnostic counter resides in the customer replaceable unit monitor.

23. The method of claim 22 wherein the recovery condition is recovering from system power loss.

24. The method of claim 22 wherein the recovery condition is recovering from paper jam.

25. The method of claim 24 wherein the type of recovery is for a high toner area coverage in the image.

26. The method of claim 24 wherein the type of recovery is for a low toner area coverage in the image.

* * * * *